United States Patent [19]

Roccaforte

[11] 4,417,661

[45] Nov. 29, 1983

[54] RECLOSABLE CARTON AND BLANK THEREFOR

[75] Inventor: Harry I. Roccaforte, Western Springs, Ill.

[73] Assignee: Champion International Corporation, Stamford, Conn.

[21] Appl. No.: 54,867

[22] Filed: Jul. 5, 1979

[51] Int. Cl.[3] ..... B65D 5/54

[52] U.S. Cl. ..... 206/625; 206/626

[58] Field of Search ..... 206/625, 626; 229/45 R

[56] References Cited

U.S. PATENT DOCUMENTS

| | | | |
|---|---|---|---|
| 1,798,333 | 3/1931 | Marlowe et al. | 229/45 X |
| 1,963,378 | 6/1934 | Petter | 229/45 |
| 2,125,042 | 7/1938 | Bergstein | 206/626 X |
| 2,619,276 | 11/1952 | Gibbons | 229/45 X |
| 2,676,751 | 4/1954 | Bolding | 229/45 X |
| 2,923,455 | 2/1960 | Tingley | 229/45 X |
| 3,357,631 | 12/1967 | Aid et al. | 206/625 X |
| 3,580,482 | 5/1971 | Witte | 206/626 |

*Primary Examiner*—Stephen P. Garbe

*Attorney, Agent, or Firm*—Evelyn M. Sommer; John H. Mulholland; William W. Jones

[57] ABSTRACT

A carton, formed of a unitary blank of paper board, having an openable pull flap which can be reclosed by the interlocking of a pull tab and a slot receiving an enlarged end of the tab. The flap is located on only one panel forming the carton or on two such panels. The tab is located either inside or outside the flap, and the slot is correspondingly located either outside or inside the flap.

2 Claims, 9 Drawing Figures

RECLOSABLE CARTON AND BLANK THEREFOR

BACKGROUND OF THE INVENTION

The present invention relates to a paper board carton, formed as a unitary blank, and more particularly relates to a carton having an openable pull flap which can be reclosed by interlocking a pull tab and a slot.

In most of the conventional paper board cartons having a plurality of panels and flaps in which materials are enclosed, it is very difficult to conveniently and securely reclose the carton once it is opened. That is, usually the carton is cut open, which provides no easy way for reclosing, or the carton is torn open thereby usually rupturing some of the panels and similarly making it difficult to reclose. While there are prior art cartons which have various pull tabs for opening cartons, these are usually totally removed from the carton, thereby once again preventing easy reclosure.

In this regard, there are now many states which require containers, such as beer and soft drink cans, to be returned for a deposit and recycling. When these cans are sold in cartons and these cartons are opened to remove their contents, it is usually difficult to securely reclose these cartons with the empty cans therein for return for the deposit and recycling.

SUMMARY OF THE INVENTION

Accordingly, it is a primary object of the present invention to provide a reclosable carton which can be easily opened and easily and securely reclosed.

Another object of the present invention is to provide a reclosable carton having a secure and positive reclosable mechanism to securely enclose articles placed in a previously opened carton, which mechanism can be repeatedly used.

Another object of the present invention is to provide a reclosable carton formed from a unitary blank of paper board.

The foregoing objects are basically attained by providing a carton having a plurality of walls connected along fold lines to provide a multi-sided body, a bottom closure for the body and a top closure for the body, the improvement comprising a flap defined in at least one of the walls by a perforated line and a fold line which is adapted to be pulled out from the body by completely severing the perforated line and folding the flap about the fold line to open the body for removal of contents therein; and reclosing means, coupled between the flap and the body outside the flap, for interlocking the flap to the body, thereby securely reclosing the body.

In particular, the reclosing means comprises a tap defined by a second perforated line and a second fold line and a slot for receiving an enlarged portion on the end of the tab.

Other objects, advantages and salient features of the present invention will become apparent from the following detailed description, which, taken in conjunction with the annexed drawings, discloses preferred embodiments of the present invention.

DESCRIPTION OF THE DRAWINGS

Referring now to the drawings which form a part of this original disclosure.

DETAILED DESCRIPTION OF THE INVENTION

Figure 1:
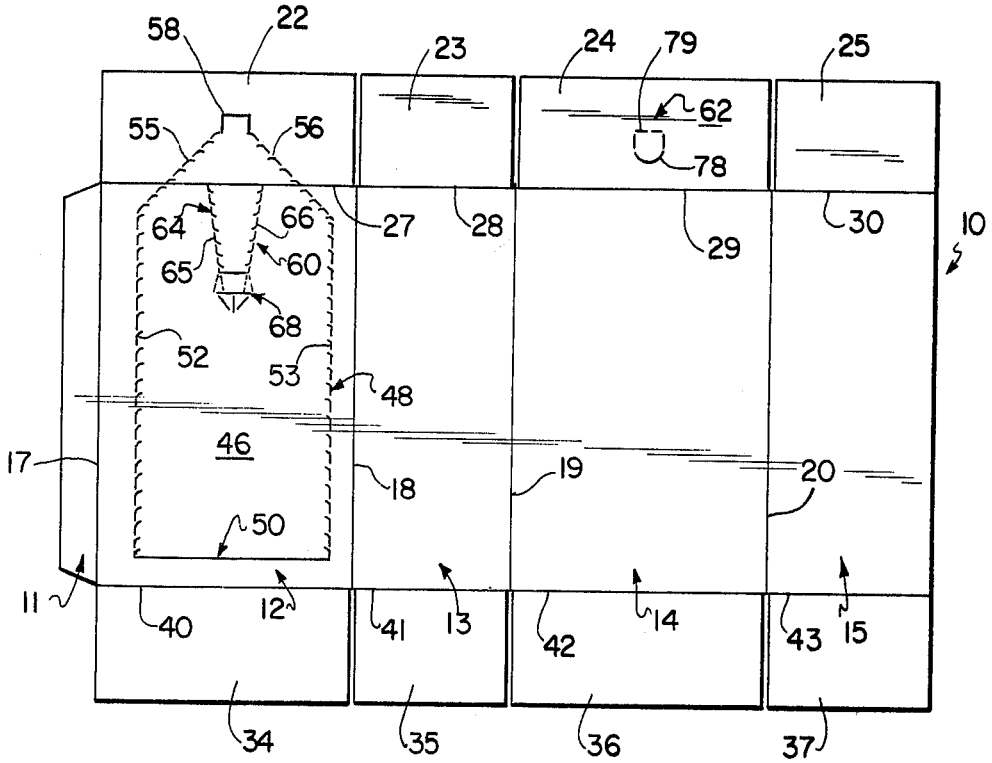
FIG. 1 is a front elevational view of a blank in accordance with the present invention showing a flap, a tab and a slot formed in the blank.

Referring now to FIG. 1, a unitary blank 10 of paper board is shown incorporating the features of the present invention. The blank 10 is comprised of a glue flap 11, a front panel 12, a first side panel 13, a rear panel 14, and a second side panel 15, which are connected in series by a plurality of parallel fold lines 17, 18, 19 and 20. Top closure flaps 22, 23, 24 and 25 each hingedly extend respectively along fold lines 27, 28, 29 and 30 from the tops of each of the front, first side, rear and second side panels. Similarly, bottom closure flaps 34, 35, 36 and 37 hingedly extend along respective fold lines 40, 41, 42 and 43 from the bottoms of each of the front, first side, rear and second side panels. With the exception of the glue flap, each of these flaps and panels are rectangular, with fold lines 27–30 being in a common line perpendicular to fold lines 17–20 and which fold lines 40–43 being in a common line similarly perpendicular to fold lines 17–20.

As seen in FIG. 1, the width of the two side panels 13 and 15 is each somewhat greater than the length of the top and bottom closure flaps, so that when folded into a conventional multi-sided body having a rectangular configuration, the top closure flap 22 associated with front panel 12 does not completely extend across the corresponding top closure flap 24 associated with the rear panel 14, as to be discussed in more detail hereinafter.

An interior pull flap 46 is located in both the front panel 12 and the top closure flap 22 associated with the front panel, the area of this flap being defined by the intersection of a first perforated line 48 and a first interior fold line 50. As seen in FIG. 1, the flap 46 has a generally rectangular shape with a triangular end; however, this flap can have any desirable shape such as rectangular, square, triangular, oval or tear drop. In all events, the first perforated line 48 must have two ends which intersect the fold line 50.

As seen in FIG. 1, the first interior fold line 50 is a straight line and extends substantially parallel to fold line 40 between bottom closure flap 34 and front panel 12. The first perforated line 48 is in the configuration of two spaced, straight parallel portions 52 and 53 located in the front panel 12 and spaced from the opposed fold lines 17 and 18 and also includes two converging straight portions 55 and 56 which extend from the top of portions 52 and 53 into a rectangular starter tap 58, which starter tab is located in top closure flap 22. As seen in FIG. 1, the portions 55 and 56 of the first perforated line 48 cross fold line 27 between flap 22 and panel 12. As is evident, the pull flap 46 may be pulled outwardly from the plane containing top closure flap 22 and front panel 12 by means of gripping the starter tab 58 and pulling the tap outwardly, completely severing the perforated line 48.

A reclosing mechanism is also located in the blank 10 and comprises a pull tap 60 located in the front panel 12 inside flap 46 and also a slot 62 located in the top closure flap 24 associated with rear panel 14.

Figure 2:
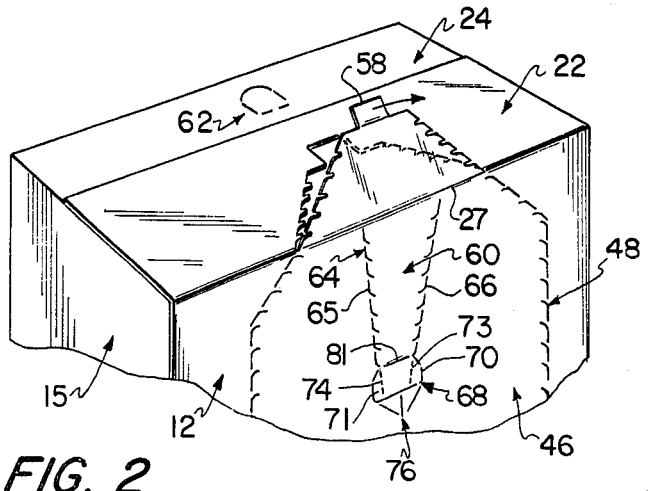
FIG. 2 is a fragmentary perspective view of the carton formed from the blank of FIG. 1 in which a portion of the flap has been separated from the multi-sided body of the carton.

The tab 60 is defined by the intersection of a second perforated line 64 and a second interior fold line which is a portion of fold line 27. The second perforated line 64 has two straight converging portions 65 and 66 which extend from the fold line 27 into an enlarged portion 68 at the distal end of pull tab 60. The enlarged portion is substantially trapezoidal in shape and is hingedly connected to the tab main area by a fold line 81. As seen in FIG. 2, this enlarged portion 68 has two opposed wings 70 and 71 formed by two converging fold lines 73 and 74 located on the interior of the enlarged portion 68 and being continuations of portions 65 and 66. Directly below the enlarged portion 68 in flap 46 and three cut lines 76 which aid in finger-grasping of the enlarged portion 68 by collapsing part of the paper board when pressure is applied thereto.

Referring again to FIG. 1, the slot 62 is formed from the intersection of a third perforated line 78 which is substantially U-shaped and a third interior fold line 79 intersecting the ends of perforated line 78. Preferably, the area of slot 62 defined thereby has a width less than the width of the enlarged portion 68 on tab 60 and a length greater than the length of the enlarged portion 68.

Referring now to FIGS. 2–5, the blank 10 of FIG. 1 has been formed into a multi-sided body in conventional fashion forming a substantially rectangularly shaped tubular carton with each of the panels referred to above forming the front, rear and two side walls. The glue flap 11 is suitably adhered to side panel or wall 15 and the various closure flaps are folded conventionally and adhered together to form the carton. In particular, it is seen in FIGS. 2–5 that the top closure flap 22 associated with front panel 12 does not fully overlap the top closure flap associated with the rear panel so that the slot 62 is exposed.

Figure 3:
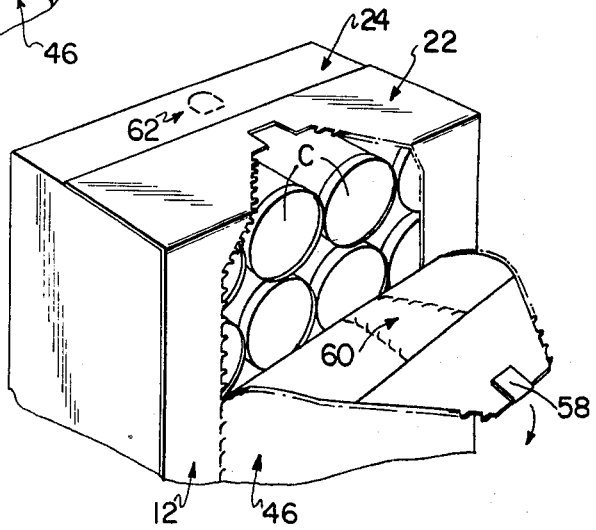
FIG. 3 is a fragmentary perspective view similar to that shown in FIG. 2 except that the flap has been further pulled away from the multi-sided body exposing the contents of the carton.

Before the closure flaps are fully closed and adhered, articles, such as beverage cans, which are labeled C and seen in FIG. 3, are placed inside the carton. With all of the closure flaps secured, the carton is shipped and ultimately purchased by the consumer. In order to easily open the carton, the starter tab 58 is grasped and the entire pull flap 46 is pulled away from the top closure flap 22 and the front panel 12 by means of fully severing the perforated line 48 and folding the pull flap 46 outwardly about fold line 50. These two steps are basically shown in FIGS. 2 and 3, the latter figure showing the pull flap in its partially opened condition.

Figure 4:
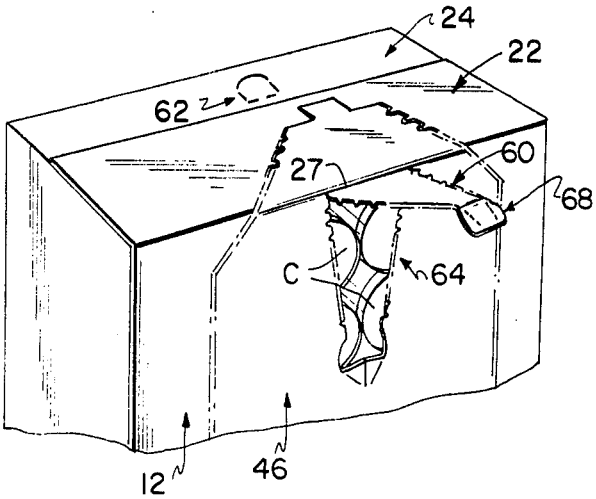
FIG. 4 is a fragmentary perspective view similar to that shown in FIG. 3 except that the opened flap has been repositioned against the multi-sided body and the tab has been pulled away from the flap.

When it is desired to reclose the carton so formed, either after only a portion of the contents have been removed or or when all of the contents have been removed and replaced, the pull flap 46 is once again maneuvered back into the planes containing front panel 12 and top closure flap 22 approximating its original position and then the pull tab 60 is manipulated. Specifically, a finger is maneuvered against the cut lines 76 in pull flap 46 so that the finger can get under and securely grasp the enlarged portion 68 on pull tab 60. Then, that tab is pulled upwardly as seen in FIG. 4, thereby fully severing the second perforated line 64. The pull tab 60 is then folded about fold line 27 and the enlarged portion 68 is pushed into the area defined by slot 62. This pushes the material defined between the third perforated line 78 and the third fold line 79 in slot 62 downwardly with a pivoting about fold line 79. In addition, the wings 70 and 71 fold upwardly about their fold lines 73 and 74 until these wings are forced beneath the flap 24 defining the slot 62. Pressure is then released and the enlarged portion 68 with its wings 70 and 71 are positively and securely engaged inside the slot. With this accomplished, the pull flap 46 is securely maintained in the reclosed position so that, for example, the used cans reclosed in the carton can be easily brought back to their point of purchase for return of deposit and recycling.

Since the slot 62 is slightly longer than the enlarged portion 68, a finger can be manipulated between the end of the enlarged portion and the end of the slot to remove the enlarged portion so that the carton can be opened and reclosed a number of times, as desired or required.

Figure 5:
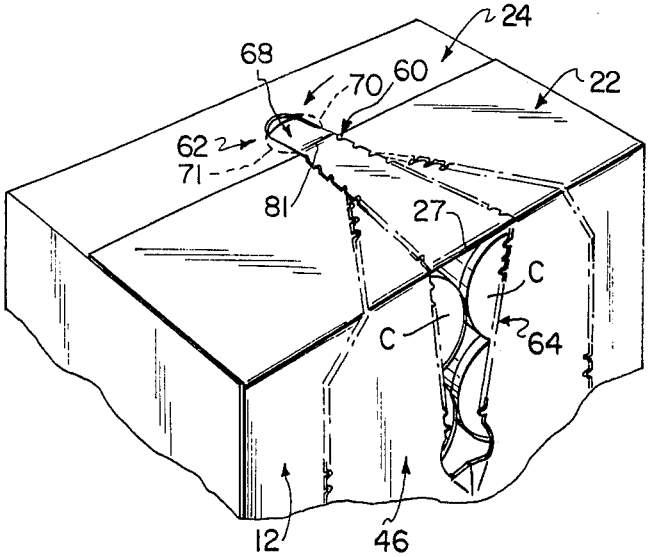
FIG. 5 is a fragmentary perspective view similar to that shown in FIG. 4 except that the tap is completely folded against the multi-sided body and the enlarged end thereof has been received by the slot.

As is evident from FIG. 5, it is advantageous to provide the pull tab 60 with a length from fold line 27 to the fold line 81 at the base of the enlarged portion substantially equal to the distance between the fold line 27 and the fold line 79 of slot 62. This provides a reasonably tight and taut connection between the pull tab 60 and slot 62, thereby positively reclosing the carton.

Figure 6:
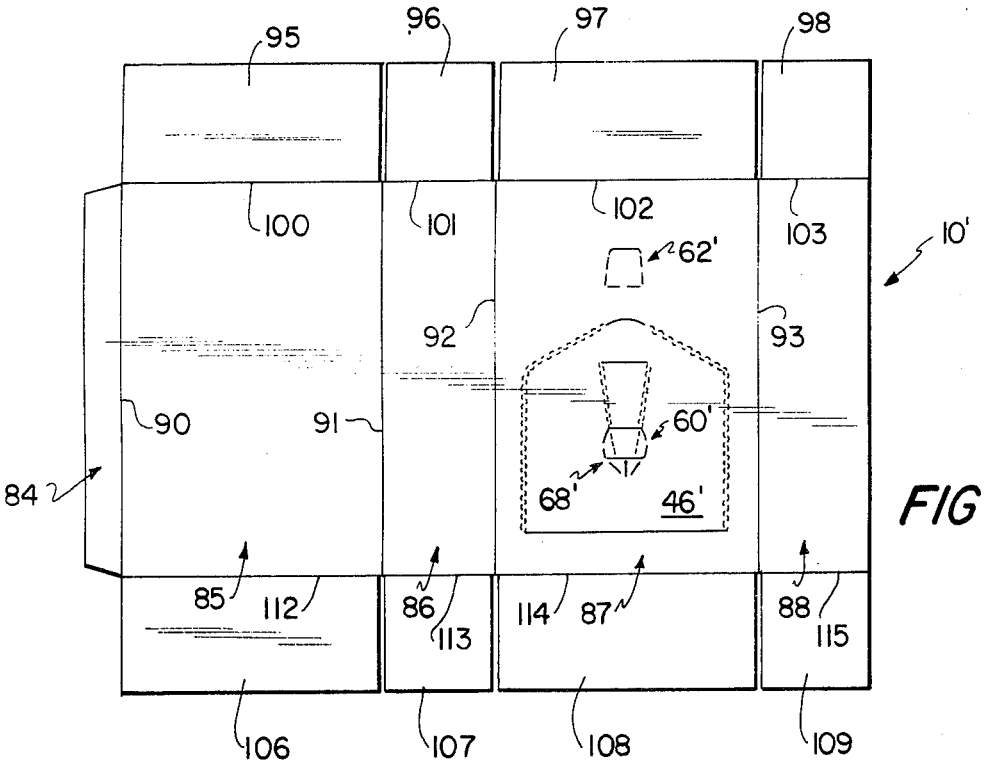
FIG. 6 is a front elevational view of a modified unitary blank in accordance with the present invention in which the flap, tab and slot are located on one panel of the blank with the tab located inside the flap and the slot outside the flap.
Figure 7:
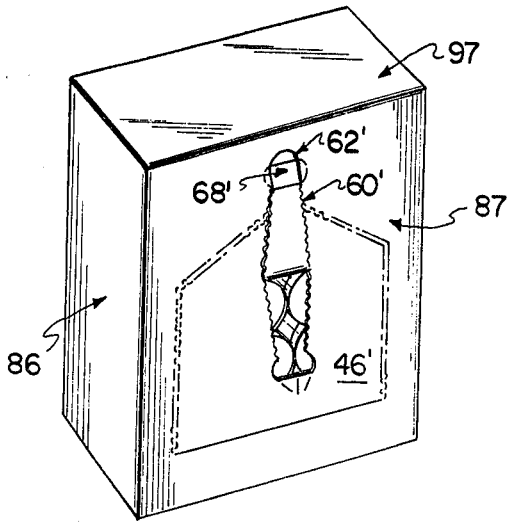
FIG. 7 is a perspective view of a carton formed from the blank shown in FIG. 6 in which the flap has been pulled away from the multi-sided body and then repositioned thereagainst, with the tab having been pulled from the multi-sided body and with its enlarged end portion being received in the slot.

Referring now to FIGS. 6 and 7, a modified blank 10' is shown in which the pull flap, pull tab and slot are located in the same panel. These parts have the same configuration as discussed above regarding the blank of FIG. 1 and are provided with character numerals 40', 60' and 62'. The operation of the reclosable feature of the present invention is substantially the same in FIG. 6 as that discussed above regarding FIG. 1 except that the pull tab 60' does not extend across a panel and a flap, but instead is limited to the front panel of the blank 10'.

In particular, the blank 10' is essentially the same as that discussed above regarding blank 10 except there is no criticality with regard to the length of the top closure flaps and the width of the side panels.

As seen in FIG. 6, blank 10' is formed substantially as is blank 10 and comprises a glue flap 84, a rear panel 85, a first side panel 86, a front panel 87 and a second side panel 88. These are hingedly coupled together along fold lines 90, 91, 92 and 93. A series of top closure flaps 95, 96, 97 and 98 are respectively hingedly connected to the tops of the panels along respective fold lines 100, 101, 102 and 103. Similarly, a series of bottom closure flaps 106, 107, 108 and 109 hingedly extend from the bottom of these panels respectively along fold lines 112, 113, 114 and 115.

The pull flap 46' is located in front panel 87 and has the same configuration as pull flap 46 and includes therein a pull tab 60' which has the same configuration as pull tab 60. The slot 62' has the same configuration as slot 62 and is so positioned such that the enlarged end portion 68' is receivable in slot 62' upon outward manipulation of the pull tab 60'.

As seen in FIG. 7, the blank 10' is conventionally formed into a multi-sided body comprising a substantially rectangularly shaped tubular carton in which the panels of the blank form the walls of the carton. As shown in FIG. 7, the pull flap 46' has been fully severed along the associated perforated line and repositioned in the plane substantially containing front panel 87; and the pull tab 60' has been pulled from the pull flap with the enlarged portion 68' being received in slot 62'. As seen in FIGS. 6 and 7, in this embodiment the pull tab 60' is located inside the area defining pull flap 46 and the slot 62' is located outside that area.

Figure 9:
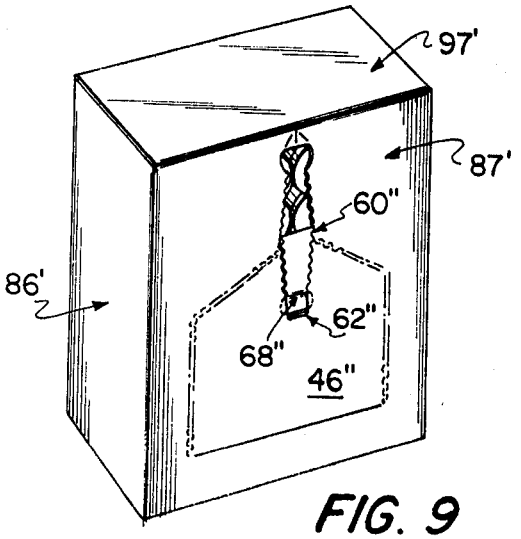
FIG. 9 is a perspective view of the carton formed from the blank shown in FIG. 8 in which the flap has been pulled away from the multi-sided body and then repositioned thereagainst, with the tab having been pulled from the multi-sided body and with its enlarged end portion being received in the slot.
Figure 8:
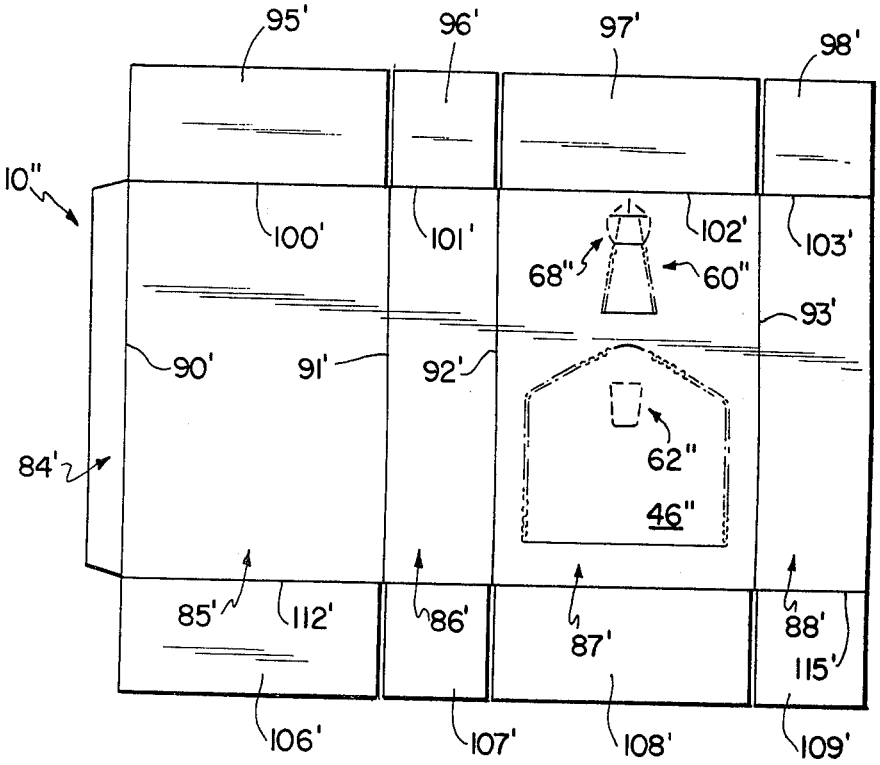
FIG. 8 is a front elevational view of another modified unitary blank in accordance with the present invention in which the flap, tab and slot are located in one panel; however, the tab is located outside the flap and the slot is located inside the flap.

Referring now to FIGS. 8 and 9, another modified blank 10'' is shown which is substantially the same as blank 10' and the same character numerals are used therein with the addition of a prime. The difference in blank 10'' over blank 10' is that the pull tab is located outside of the pull flap and the slot is located inside that flap.

The configuration of the pull flap is the same in blank 10' as in blanks 10 and 10' so a description will not be repeated, the pull flap being designated by 46''. Similarly, the pull tab is of similar configuration as that disclosed in blanks 10 and 10' and is designated by 60''. Finally, the slot is also of the same configuration as the slots of blanks 10 and 10' and is designated 62''.

The difference between the blank 10' and blank 10'' is that the pull tab 60'' is located outside of the pull flap 46'' and the slot 62' is located inside the area defining pull flap 46''.

In all events, the operation of the reclosing mechanism is the same except that the pull tab 60'' folds out from the front panel 87' into the slot 62'' in pull flap 46''. This is shown in FIG. 9 in which the blank 10'' has been formed into a multi-sided substantially rectangularly shaped tubular carton.

While various embodiments have been chosen to illustrate the invention, it will be understood by those skilled in the art that various changes and modifications can be made therein without departing from the scope of the invention as defined in the appended claims.

What is claimed is:

1. A unitary blank for a carton formed of paperboard comprising:

(a) a front panel, a rear panel, and two side panels connected along generally parallel fold lines;

(b) a top closure flap hingedly extending along a fold line from the top of each of said front, rear, and two side panels;

(c) a bottom closure flap hingedly extending along a fold line from the bottom of each of said front, rear, and two side panels;

(d) an interior flap area in at least one of said panels and closure flaps defined by the intersection of a first perforated line and a first interior fold line;

(e) a tab area located in said interior flap and defined by the intersection of a second perforated line and a second interior fold line, said second perforated line defining an enlarged distal end on said tab area, said tab folding about said second interior fold line such that said tab and said interior flap fold in opposite directions; and (f) a slot area located outside said interior flap area and defined by the intersection of a third perforated line and a third interior fold line, said slot area receiving said folded tab and having a width less than the width of said enlarged distal end whereby said flap is interlocked to said body thereby securely reclosing said body.

2. A blank according to claim 1 wherein said flap area extends into an adjacent panel.

* * * * *

UNITED STATES PATENT AND TRADEMARK OFFICE

CERTIFICATE OF CORRECTION

PATENT NO. : 4,417,661

DATED : November 29, 1983

INVENTOR(S) : Harry I. Roccaforte

It is certified that error appears in the above—identified patent and that said Letters Patent is hereby corrected as shown below:

Col. 1, line 53, delete "tap" and insert in lieu thereof -- tab -- ;

Col. 2, line 14, delete "tap" and insert in lieu thereof -- tab -- ;

Col. 2, line 58, delete "which" and insert in lieu thereof -- with -- ;

Col. 3, line 19, delete "tap" and insert in lieu thereof -- tab -- ;

Col. 3, line 26, delete "tap" and insert in lieu thereof -- tab -- ;

Col. 3, line 29, delete "tap" and insert in lieu thereof -- tab -- ;

Col. 3, line 45, delete "and" and insert in lieu thereof -- are -- ;

UNITED STATES PATENT AND TRADEMARK OFFICE

CERTIFICATE OF CORRECTION

PATENT NO. : 4,417,661
DATED : November 29, 1983
INVENTOR(S) : Harry I. Roccaforte It is certified that error appears in the above—identified patent and that said Letters Patent is hereby corrected as shown below:

Col. 3, line 58, delete "in conventional" and insert in lieu thereof -- in a conventional -- ;

Col. 5, line 37, delete "10′ ", first occurrence and insert in lieu thereof -- 10'' --.

Col. 6, line 1, delete "62'" and insert in lieu thereof -- 62" -- .

Signed and Sealed this

Twentieth Day of November 1984

[SEAL]

Attest:

GERALD J. MOSSINGHOFF

Attesting Officer

Commissioner of Patents and Trademarks